US012702177B2

(12) United States Patent
Zreik et al.

(10) Patent No.: US 12,702,177 B2
(45) Date of Patent: Aug. 11, 2026

(54) LASH BAND FOR ARTIFICIAL LASHES

(71) Applicant: LASH OPCO, LLC, Southlake, TX (US)

(72) Inventors: Marwan Zreik, Aliso Viejo, CA (US); Erica Pearson, Los Angeles, CA (US)

(73) Assignee: LASH OPCO, LLC, Southlake, TX (US)

( * ) Notice: Subject to any disclaimer, the term of this patent is extended or adjusted under 35 U.S.C. 154(b) by 120 days.

(21) Appl. No.: 18/784,371

(22) Filed: Jul. 25, 2024

(65) Prior Publication Data

US 2024/0373967 A1 Nov. 14, 2024

Related U.S. Application Data

(63) Continuation of application No. 18/176,732, filed on Mar. 1, 2023, now Pat. No. 12,059,046.

(60) Provisional application No. 63/268,739, filed on Mar. 1, 2022.

(51) Int. Cl.
*A41G 5/02* (2006.01)

(52) U.S. Cl.
CPC ..... *A41G 5/02* (2013.01)

(58) Field of Classification Search
CPC ..... A41G 5/02; A45D 31/00
See application file for complete search history.

(56) References Cited

U.S. PATENT DOCUMENTS

| | | | | |
|---|---|---|---|---|
| 2,835,259 | A * | 5/1958 | Bertrand | A41G 5/02 D28/99 |
| 3,266,500 | A * | 8/1966 | Weld | A41G 5/02 132/320 |
| 8,225,800 | B2 | 7/2012 | Byrne | |
| 8,347,896 | B2 | 1/2013 | Liao | |
| 8,596,284 | B2 | 12/2013 | Byrne | |
| 8,657,170 | B2 | 2/2014 | Martinez | |
| 8,881,741 | B1 | 11/2014 | Mattson et al. | |
| 9,149,083 | B1 | 10/2015 | Dinh | |
| 9,185,943 | B2 | 11/2015 | Merszei | |
| 9,326,558 | B2 | 5/2016 | Martins et al. | |
| 9,486,025 | B1 | 11/2016 | Dinh | |
| 9,848,662 | B2 | 12/2017 | Dinh | |
| 9,913,506 | B2 | 3/2018 | Hansen et al. | |
| D850,715 | S | 6/2019 | Lotti | |
| 10,638,826 | B2 | 5/2020 | Lotti | |
| 10,660,388 | B2 | 5/2020 | Lotti | |

(Continued)

FOREIGN PATENT DOCUMENTS

| | | |
|---|---|---|
| WO | WO 2015/116247 A1 | 8/2015 |
| WO | WO 2020/172746 A1 | 9/2020 |

OTHER PUBLICATIONS

Extended European Search Report for European Patent Application No. 23764067.7 issued by the European Patent Office, dated Dec. 4, 2025. (9 pgs.).

(Continued)

*Primary Examiner* — Rachel R Steitz

(74) *Attorney, Agent, or Firm* — Haynes and Boone, LLP

(57) ABSTRACT

An artificial eyelash extension unit includes a lash band supporting a plurality of artificial lashes. The lash band is an elongated member having a non-uniform property along its length. The property may include a cross-sectional dimension, composition, or a chemical or physical property such as modulus of elasticity or degree of cross-linking.

10 Claims, 14 Drawing Sheets

(56) References Cited

U.S. PATENT DOCUMENTS

| | | | |
|---|---|---|---|
| D890,430 | S | 7/2020 | Lotti |
| 10,716,349 | B2 | 7/2020 | Merszei |
| 10,721,984 | B2 | 7/2020 | Lotti |
| 10,813,874 | B2 | 10/2020 | Lee et al. |
| 10,888,133 | B2 | 1/2021 | Merszei |
| 11,219,260 | B2 | 1/2022 | Lotti |
| 11,234,472 | B2 | 2/2022 | Lotti |
| 11,253,020 | B2 | 2/2022 | Lotti |
| 11,330,855 | B2 | 5/2022 | Lotti |
| 11,330,856 | B2 | 5/2022 | Lotti |
| 2008/0196732 | A1 | 8/2008 | Merszei |
| 2010/0043816 | A1 | 2/2010 | Dix |
| 2012/0180804 | A1 | 7/2012 | Hochi et al. |
| 2014/0332025 | A1 | 11/2014 | Kim et al. |
| 2015/0201692 | A1 | 7/2015 | Hansen et al. |
| 2016/0037848 | A1 | 2/2016 | Lee |
| 2016/0192724 | A1 | 7/2016 | Scott et al. |
| 2016/0206031 | A1 | 7/2016 | Stoka |
| 2019/0183200 | A1 | 6/2019 | Song |
| 2019/0380413 | A1 | 12/2019 | Lotti |
| 2020/0196694 | A1 | 6/2020 | Lotti |
| 2020/0260839 | A1 | 8/2020 | Lotti |
| 2020/0275718 | A1 | 9/2020 | Sharafatdinova |
| 2020/0281295 | A1 | 9/2020 | Lotti |
| 2020/0323325 | A1 | 10/2020 | Kim et al. |
| 2020/0323329 | A1 | 10/2020 | Kim et al. |
| 2020/0390175 | A1 | 12/2020 | Lotti |
| 2020/0390176 | A1 | 12/2020 | Lotti |
| 2021/0095170 | A1 | 4/2021 | Lotti |
| 2021/0100306 | A1 | 4/2021 | Lotti |
| 2021/0161233 | A1 | 6/2021 | Lotti |
| 2021/0195976 | A1 | 7/2021 | Lotti |
| 2022/0279883 | A1 | 9/2022 | Lotti |

OTHER PUBLICATIONS

International Search Report and Written Opinion issued by the United States Patent and Trademark Office as International Searching Authority for PCT/US2023/063453, dated Jul. 11, 2023, 14 pgs.

* cited by examiner

LASH BAND FOR ARTIFICIAL LASHES

CROSS-REFERENCE TO RELATED APPLICATIONS

This application is a continuation of U.S. Nonprovisional application Ser. No. 18/176,732 filed Mar. 1, 2023, which claims priority to U.S. Provisional Application No. 63/268,739 filed Mar. 1, 2022, the contents of which are herein incorporated in their entirety.

FIELD OF THE DISCLOSURE

The present disclosure relates to artificial lashes. More particularly, the disclosure relates to a lash band for artificial lashes having at least one variable property along a length thereof.

BACKGROUND

Artificial eyelashes may be used to alter the appearance of natural lashes, for example, by making the natural lashes appear longer or thicker. Artificial eyelashes may be applied professionally or at home (at-home lashes) and come in a variety of formats, including individual lashes and strip lashes. Strip lashes generally include an elongated base ("lash band") onto which a plurality of artificial lash filaments is secured. Traditional lash bands are uniform along their length despite natural eyelash and eyeline (i.e., a distal portion of the eyelid from which the natural lashes extend) not being uniform from an inner corner of the eye to an outer corner of the eye. When such lash bands are applied to natural lashes or an eyeline, this mismatch (e.g., a stiff or thick portion on a more delicate portion of the eyelid) can cause the lash band to become prematurely disengaged from the natural lashes or eyelid.

BRIEF DESCRIPTION OF THE DRAWINGS

Various embodiments of the present disclosure will be understood more fully from the detailed description given below and from the accompanying drawings. In the drawings, like reference numbers may indicate identical or functionally similar elements. Embodiments are described in detail hereinafter with reference to the accompanying figures, in which.

DETAILED DESCRIPTION

Figure 1:
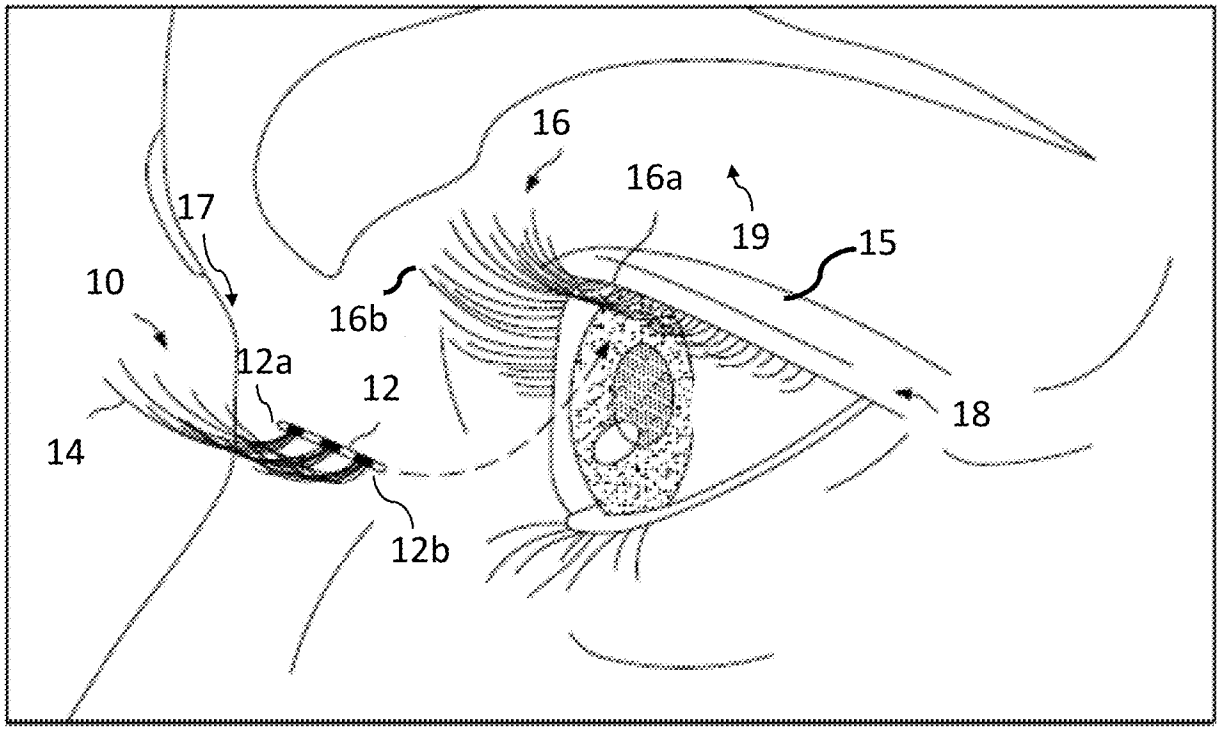
FIG. 1 is a perspective view of an artificial eyelash unit being applied to natural lashes according to an embodiment of the present disclosure.

The following disclosure provides many different embodiments or examples. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Referring to FIG. 1, an artificial eyelash extension unit 10 is configured to be applied to natural lashes, such as upper natural lashes 16. In some embodiments, the extension unit 10 may be configured to be applied to an underside of the upper natural lashes 16, a top side thereof, or both the underside and top side of the upper natural lashes 16. Each of the upper natural lashes 16 have a root 16*a* extending from an eyeline 18 toward a distal end 16*b* of the upper natural lash 16.

The extension unit 10 includes a lash band 12 extending from an inner end 12*a* to an outer end 12*b*, wherein the inner end 12*a* is configured to be positioned toward an inner corner of the eyeline 18 nearest the bridge of nose 17. The extension unit 10 includes a plurality of lashes 14 connected to and extending from the lash band 12. In some embodiments, a plurality of artificial extension units 10 may be applied to the upper natural lashes 16. In other embodiments, a single extension unit 10 may be applied to the upper natural lashes 16. Application of the extension unit 10 to the natural lashes 16 may include the use of a mechanical fastener (e.g., thread or magnets) and/or the use of an adhesive, wherein the adhesive may be applied to any of the lash band 12, the plurality of lashes 14, the upper natural lashes 16, the cycline 18, or combinations thereof. Any known adhesive may be employed.

The eyeline 18 of each user may vary and can include irregularities that contribute to premature disengagement of the extension unit 10. For example, the eyeline 18 may have varying degrees of curvature at different locations along the same and the skin along the eyeline can vary in thickness and/or sensitivity. Additionally, the natural lashes 16 may vary in length and thickness along the eyeline 18. Further, contact between the eyeline 18 and/or natural lashes 16 and a user's eyelid 15 and/or brow 19 may also contribute to premature disengagement of the extension unit 10, and the eyelid 15 and/or brow 19 shape and size may vary between users. As described herein, in various embodiments, varying at least one property of the lash band 12 along the length thereof accommodates the unique properties of users' eyes.

Figure 2:
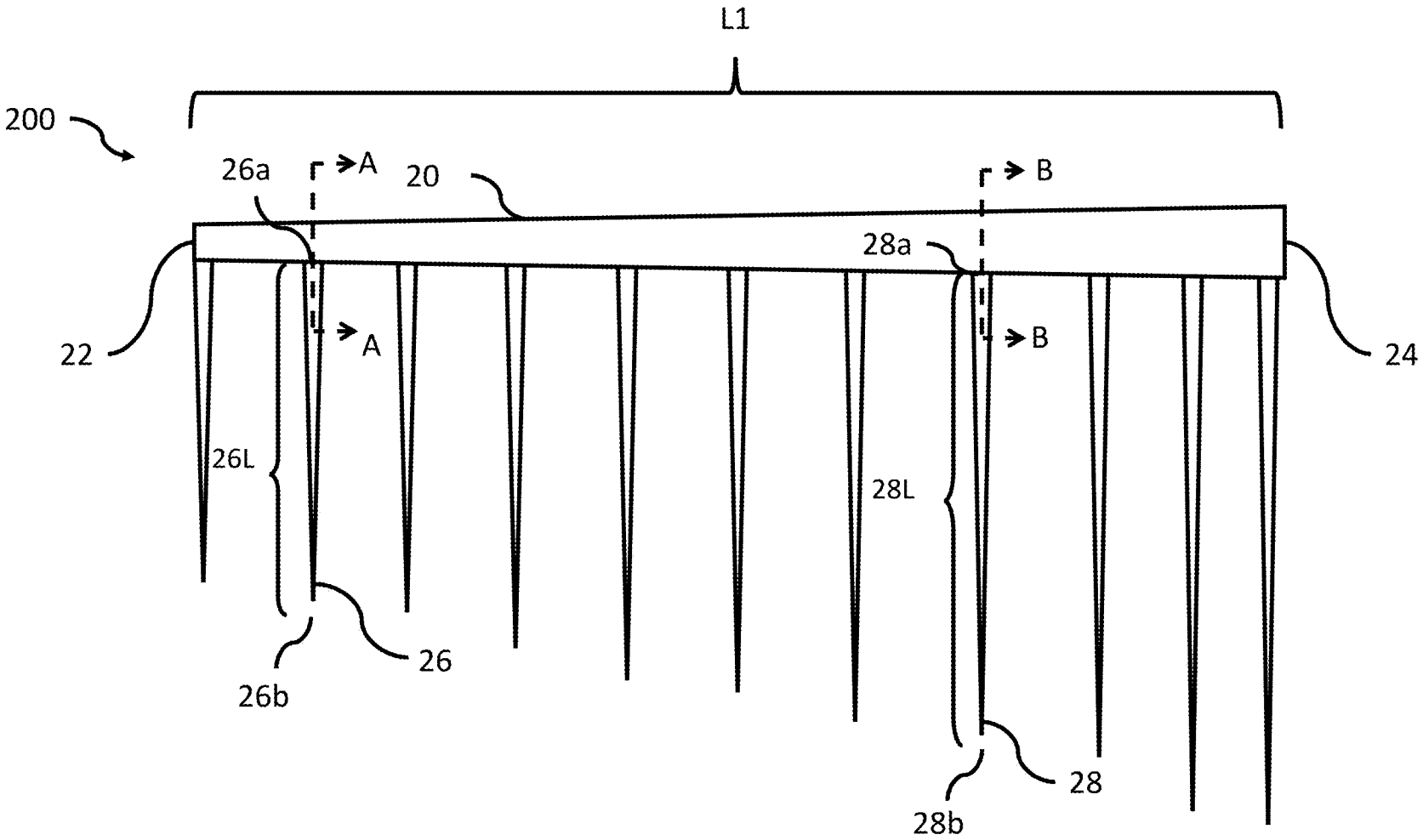
FIG. 2 is a top view of a lash band according to an embodiment of the present disclosure.
Figure 2B:
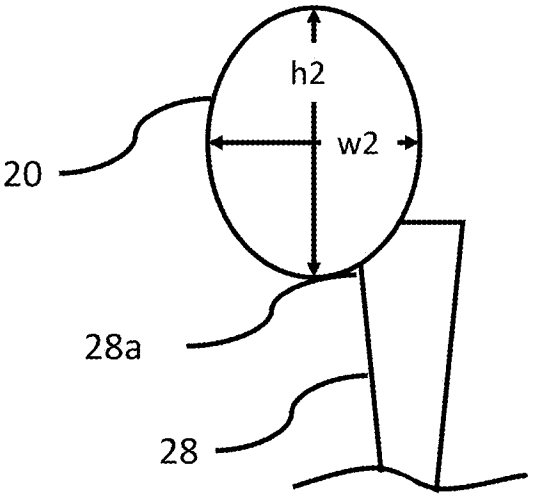
FIG. 2B is a cross-sectional view along line B-B in FIG. 2.
Figure 2A:
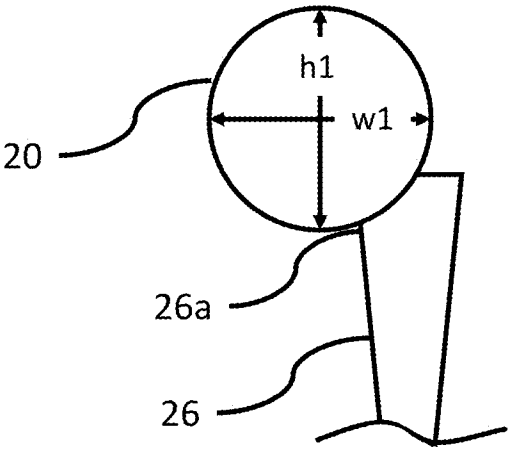
FIG. 2A is a cross-sectional view along line A-A in FIG. 2.

Turning to FIG. 2, in one or more embodiments, the extension unit 10 is an artificial eyelash extension unit 200. The extension unit 200 includes a lash band 20 having a first end 22, a second end 24, and a length L1 defined between the first end 22 and the second end 24. The extension unit 200 further includes at least two lash filaments 26, 28 extending from the lash band 20. The lash filament 26 has a length 26L defined from a lash base 26*a* where the lash filament 26 is secured to the lash band 20 to a lash tip 26*b*, which is a distal end of the lash filament 26. The lash filament 28 has a length 28L defined from a lash base 28*a* where the lash filament 28 is secured to the lash band 20 to a lash tip 28*b*, which is a distal end of the lash filament 28. In some embodiments and as shown in FIG. 2, the length 26L is not equal to the length 28L. FIG. 2A depicts a partial cross-sectional view of the extension unit 200 at the line A-A, where the lash filament 26 is located along the length L1 of the lash band 20. In FIG. 2A, it can be seen that the lash band 20 has dimensions h1 and w1 at this position along the length L1 of the lash band 20, wherein h1 and w1 may be the same or different from one another. FIG. 2B depicts a partial cross-sectional view of the extension unit 200 at the line B-B, where the lash filament 28 is located along the length L1 of the lash band 20. In FIG. 2B, it can be seen that the lash band 20 has dimensions h2 and w2 at this position along the length L1 of the lash band 20, wherein h2 and w2 may be the same or different from one another. According to some embodiments of the present disclosure, h1 and h2 are different from one another and/or w1 and w2 are different from one another. That is, according to some embodiments the lash band 20 has at least one non-uniform dimension along the length L1 thereof.

In some embodiments, at least one cross-sectional dimension of the lash band 20 may differ along a length thereof while a cross-sectional area of the lash band 20 remains unchanged (e.g., a width may be reduced while a height is increased thereby maintaining the same cross-sectional area). In some embodiments, the cross-sectional area of the lash band 20 differs along a length thereof.

A filament to band ratio can be defined for each lash filament 26, 28 as the ratio of the length of the lash filament (e.g., 26L or 28L) to a cross-sectional dimension of the lash band 20 at the longitudinal location of said lash filament 26, 28. The cross-sectional dimension may be, e.g., a length, a width, or a cross-sectional area of the lash band 20. In some embodiments, the extension unit 200 may include eyelash filaments having different lengths and equal filament to band ratios. For example, with reference to FIG. 2, the length 26L and 28L may be unequal and a ratio of 26L to h1 may be equal to a ratio of 28L to h2.

In an embodiment, as shown in FIGS. 2, 2A, and 2B, the decreased thickness of lash band 20 proximate the first end 22 results in increased flexibility (and/or reduced stiffness) as compared with a remainder of the lash band 20. In operation, as discussed above with reference to FIG. 1, the first end 22 is configured to be attached to natural lashes 16 proximate an inner corner of the eyeline 18. Accordingly, the increased flexibility of the first end 22 as compared to the remainder of the lash band 20 accommodates structural irregularities of the eyeline 18 at the inner corner thereof (e.g., a higher degree of curvature) and thereby reduces the risk of premature disengagement of the lash band 20 (and the extension unit 200 comprising the same) from the cycline 18 and/or natural lashes 16. Further, the increased flexibility and reduced mass of the first end 22 allows for a more comfortable fit as the eyeline 18 may be more sensitive closer to the inner corner due to, e.g., more delicate skin and/or a sharper degree of curvature. Moreover, by reducing the thickness of the lash band 20 at a portion thereof, the weight of the extension unit 200 is reduced, which further contributes to the aforementioned durability and comfort.

Figure 3:
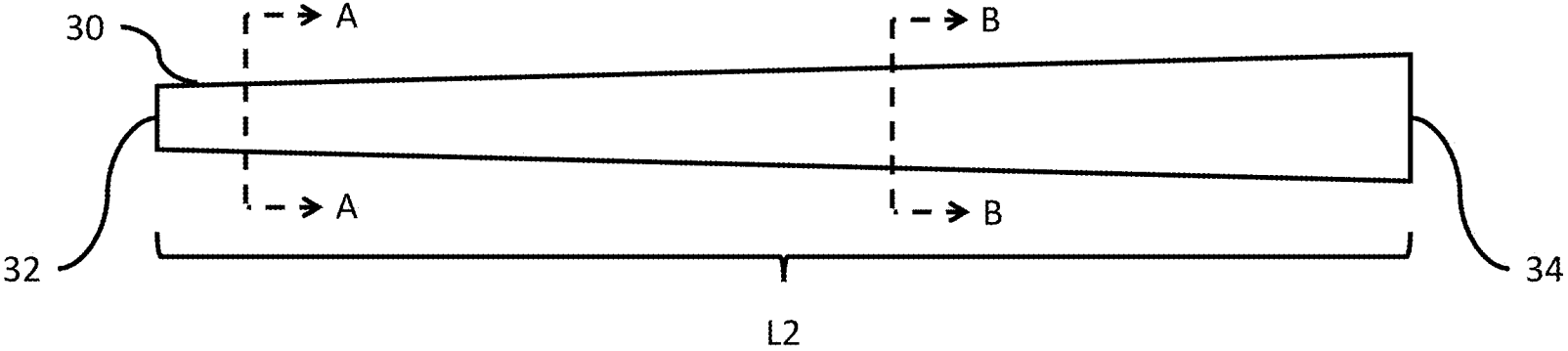
FIG. 3 is a top view of a lash band according to an embodiment of the present disclosure.
Figure 3B:
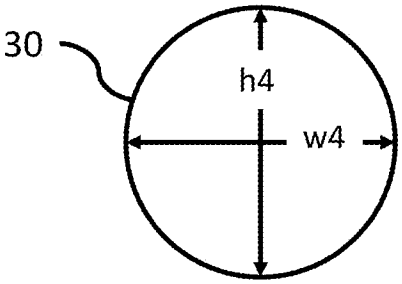
FIG. 3B is a cross-sectional view along line B-B in FIG. 3.
Figure 3A:
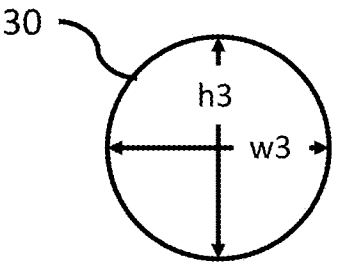
FIG. 3A is a cross-sectional view along line A-A in FIG. 3.

Referring to FIG. 3, in one or more embodiments, the lash band used in the extension unit 10, 200 may be a lash band 30. The lash band 30 include a first end 32 and a second end 34 with a length L2 defined therebetween. FIG. 3A is a cross-sectional view along the line A-A in FIG. 3. In FIG. 3A, it can be seen that the lash band 30 has dimensions h3 and w3 at this position along the length L2 of the lash band 30, wherein h3 and w3 may be the same or different from one another. FIG. 3B is a cross-sectional view along the line B-B in FIG. 3. In FIG. 3B, it can be seen that the lash band 30 has dimensions h4 and w4 at this position along the length L2 of the lash band 30, wherein h4 and w4 may be the same or different from one another. According to some embodiments of the present disclosure, h3 and h4 are different from one another and/or w3 and w4 are different from one another. That is, the lash band 30 has at least one non-uniform dimension along a length thereof. In some embodiments, the first end 32 may be correspond to the inner end 12*a* of the lash band 12. In other embodiments, the second end 34 may correspond to the inner end 12*a* of the lash band 12.

In an embodiment, as shown in FIGS. 3, 3A, and 3B, operations and advantages of the lash band 30 include those described with reference to FIGS. 2, 2A, and 2B above.

Figure 4:
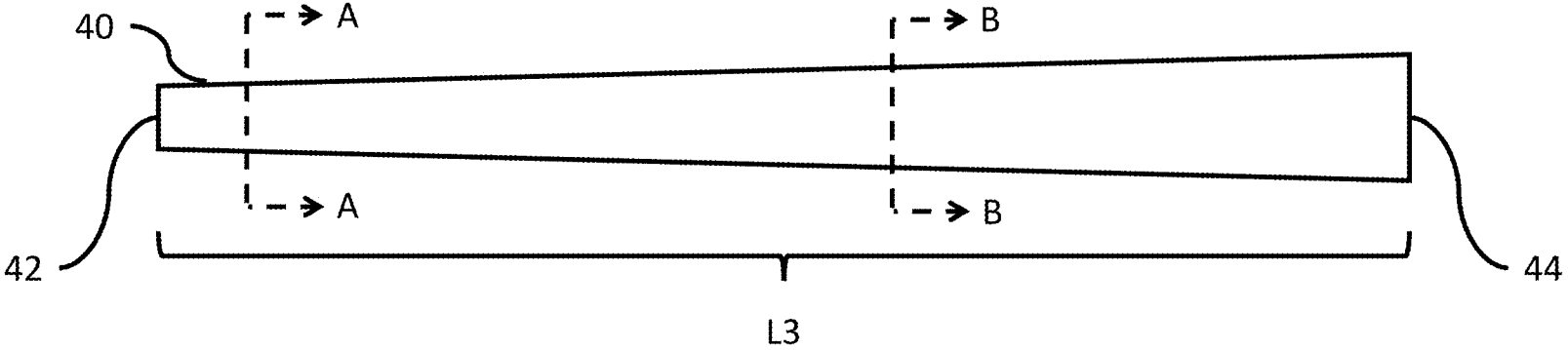
FIG. 4 is a top view of a lash band according to an embodiment of the present disclosure.
Figure 4B:
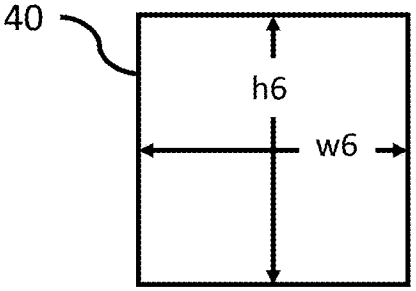
FIG. 4B is a cross-sectional view along line B-B in FIG. 4.
Figure 4A:
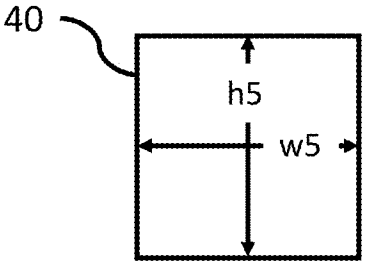
FIG. 4A is a cross-sectional view along line A-A in FIG. 4.

Turning to FIG. 4, another lash band 40 according to one or more embodiments of the present disclosure is shown. The lash band 40 include a first end 42 and a second end 44 with a length L3 defined therebetween. FIG. 4A is a cross-sectional view along the line A-A in FIG. 4. In FIG. 4A, it can be seen that the lash band 40 has dimensions h5 and w5 at this position along the length L3 of the lash band 40, wherein h5 and w5 may be the same or different from one another. FIG. 4B is a cross-sectional view along the line B-B in FIG. 4. In FIG. 4B, it can be seen that the lash band 40 has dimensions h6 and w6 at this position along the length L3 of the lash band 40, wherein h6 and w6 may be the same or different from one another. According to some embodiments of the present disclosure, h5 and h6 are different from one another and/or w5 and w6 are different from one another. That is, the lash band 40 has at least one non-uniform dimension along the length L3 thereof.

In an embodiment, as shown in FIGS. 4, 4A, and 4B, operations and advantages of the lash band 40 include those described with reference to FIGS. 2, 2A, and 2B above.

Figure 5A:
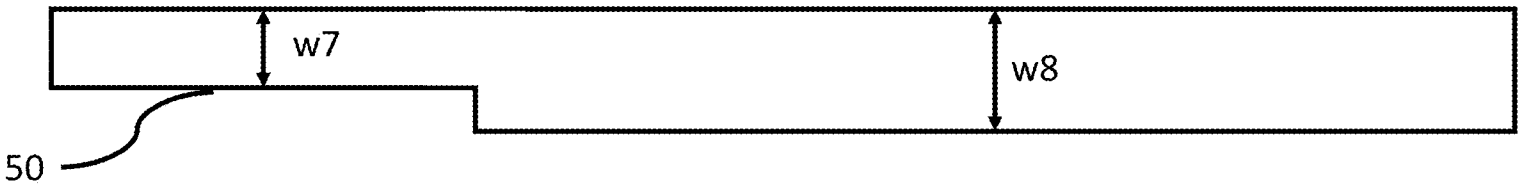
FIG. 5A is a top view of a lash band according to an embodiment of the present disclosure.
Figure 5B:
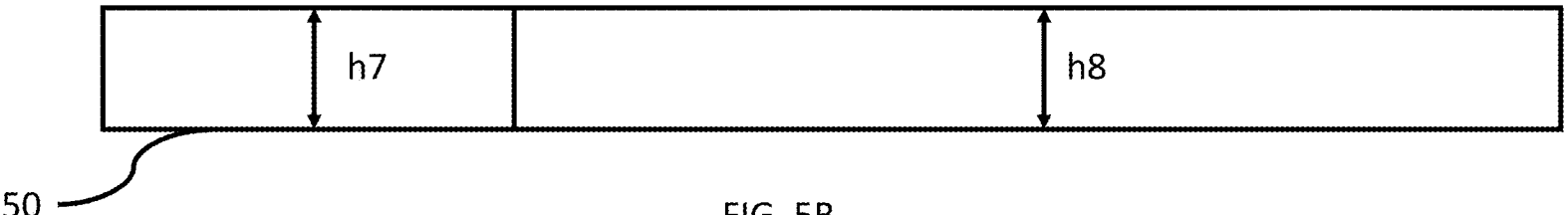
FIG. 5B is a front view of the lash band of FIG. 5A.

Referring to FIG. 5A and FIG. 5B, a lash band 50 according to an embodiment of the present disclosure is shown. The lash band 50 includes a stepped profile, wherein dimension w7 is less than w8. In FIG. 5B, the dimensions h7 and h8 may be the same or different. The dimensions w7 and h7 are taken at the same longitudinal position on the lash band 50 and may be the same or different. Likewise, the dimensions w8 and h8 are taken at the same longitudinal position on the lash band 50 and may be the same or different.

In an embodiment, as shown in FIGS. 5A and 5B, operations and advantages of the lash band 50 include those described with reference to FIGS. 2, 2A, and 2B above.

Figure 6A:
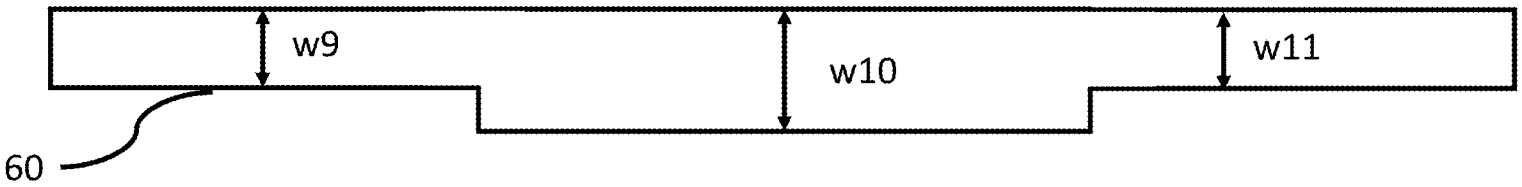
FIG. 6A is a top view of a lash band according to an embodiment of the present disclosure.
Figure 6B:
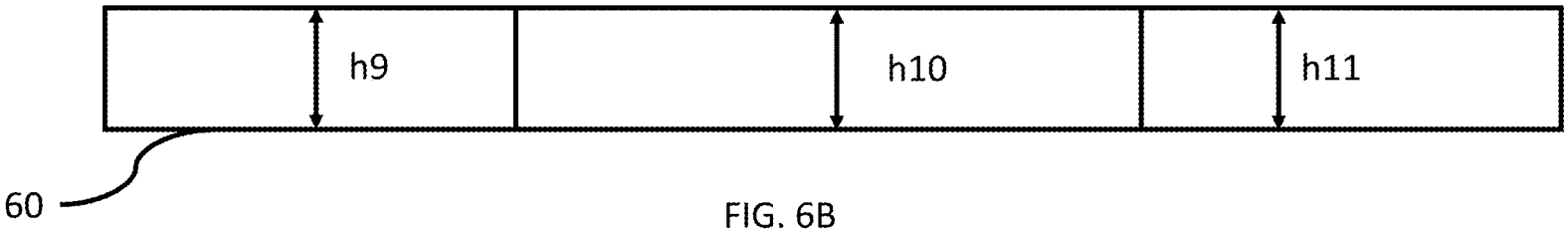
FIG. 6B is a front view of the lash band of FIG. 6A.

Referring to FIG. 6A and FIG. 6B, a lash band 60 according to an embodiment of the present disclosure is shown. The lash band 60 includes a stepped profile, wherein dimensions w9 and w11 are each is less than w10. In FIG. 6B, the dimensions h9, h10, and h11 may be the same or different. The dimensions w9 and h9 are taken at the same longitudinal position on the lash band 60 and may be the same or different. Likewise, the dimensions w10 and h10 are taken at the same longitudinal position on the lash band 60 and may be the same or different. Lastly, the dimensions w11 and h11 are taken at the same longitudinal position on the lash band 60 and may be the same or different.

In an embodiment, as shown in FIGS. 6A and 6B, operations and advantages of the lash band 60 include those described with reference to FIGS. 2, 2A, and 2B above. Additionally, by including a reduction of thickness at both ends of the lash band 60 as shown in FIG. 6A, the lash band 60 is further reduced in weight, which may yield increased comfort and durability for an extension unit comprising the same. Moreover, by including the reduction of thickness on both ends of the lash band 60, again as shown in FIG. 6A, the lash band 60 can accommodate irregularities at both ends of the eyeline 18 (e.g., as with the inner corner of the eyeline 18, the outer corner may have a more dramatic degree of curvature as compared to a midsection of the cycline 18). This feature further decreases the chances of a premature disengagement of the lash band 60 and further improves comfort.

Figure 7:
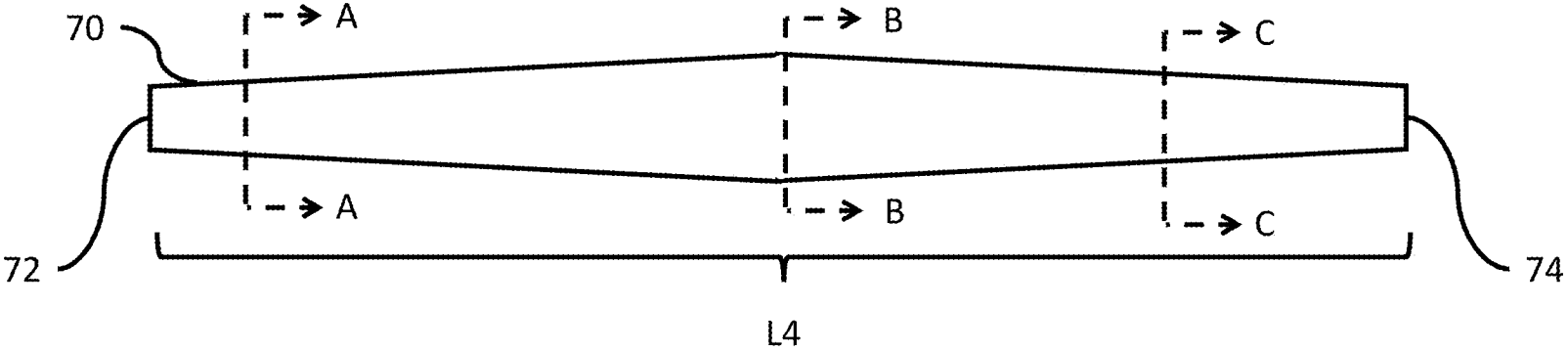
FIG. 7 is a top view of a lash band according to an embodiment of the present disclosure.
Figure 7C:
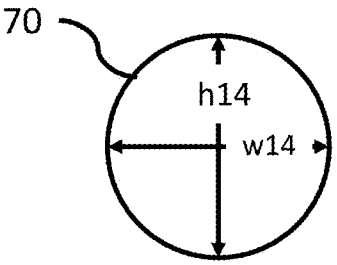
FIG. 7C is a cross-sectional view along line C-C in FIG. 7.
Figure 7B:
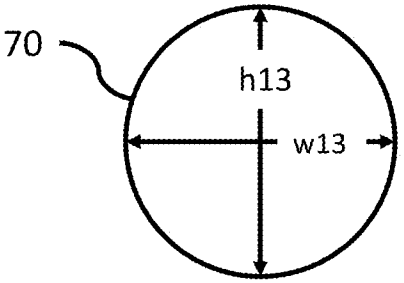
FIG. 7B is a cross-sectional view along line B-B in FIG. 7.
Figure 7A:
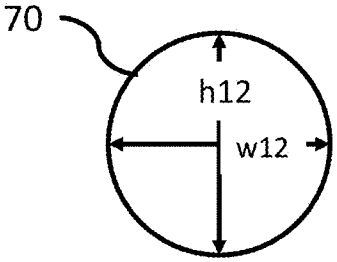
FIG. 7A is a cross-sectional view along line A-A in FIG. 7.

Turning to FIG. 7, another lash band 70 according to one or more embodiments of the present disclosure is shown. The lash band 70 include a first end 72 and a second end 74 with a length L4 defined therebetween. FIG. 7A is a cross-sectional view along the line A-A in FIG. 7. In FIG. 7A, it can be seen that the lash band 70 has dimensions h12 and w12 at this position along the length L4 of the lash band 70, wherein h12 and w12 may be the same or different from one another. FIG. 7B is a cross-sectional view along the line B-B in FIG. 7. In FIG. 7B, it can be seen that the lash band 70 has dimensions h13 and w13 at this position along the length L4 of the lash band 70, wherein h13 and w13 may be the same or different from one another. FIG. 7C is a cross-sectional view along the line C-C in FIG. 7. In FIG. 7C, it can be seen that the lash band 70 has dimensions h14 and w14 at this position along the length L4 of the lash band 70, wherein h14 and w14 may be the same or different from one another. According to some embodiments of the present disclosure, at least two of h12, h13, and h14 are different from one another and/or at least two of w12, w13, and w13 are different from one another. That is, the lash band 70 has at least one non-uniform dimension along the length L4 thereof.

In an embodiment, as shown in FIGS. 7, 7A, 7B, and 6C, operations and advantages of the lash band 70 include those described with reference to FIGS. 2, 2A, and 2B and FIGS. 6A and 6B above.

Figure 8A:
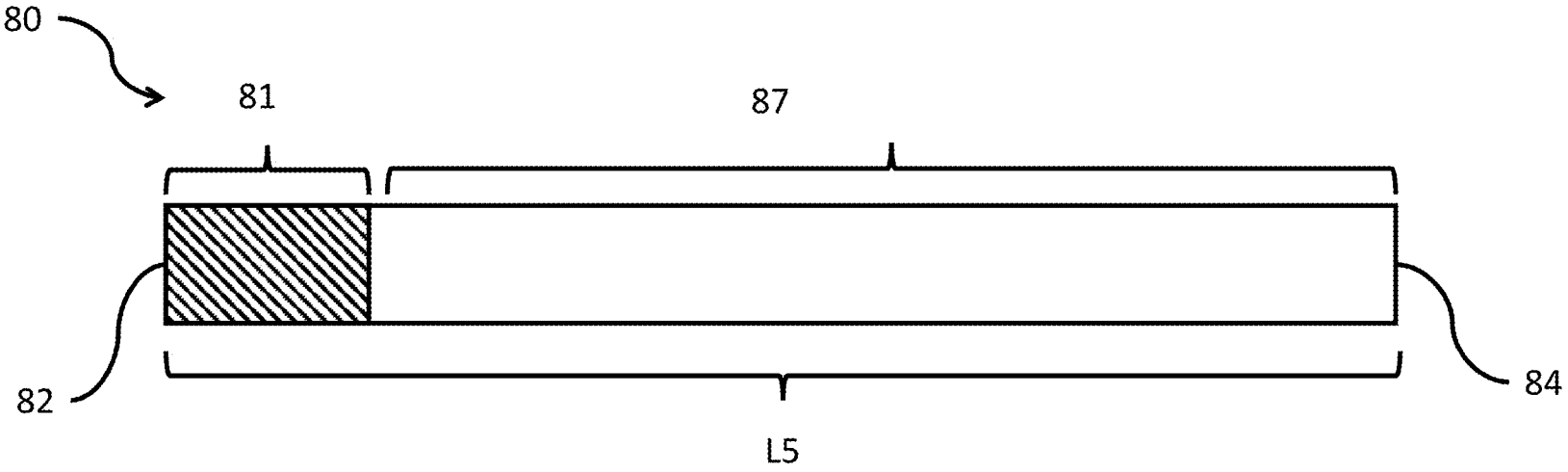
FIG. 8A is a top view of a lash band according to an embodiment of the present disclosure.

Turning to FIG. 8A, a lash band 80 according to an embodiment of the present disclosure is shown. The lash band 80 has a first end 82, a second end 84, and a length L5 defined between the first end 82 and the second end 84. The lash band 80 includes a first end portion 81 proximate the first end 82 and a main portion 87 between the first end portion 81 and the second end 84. In one or more embodiments, the first end portion 81 and the main portion 87 have different physical and/or chemical properties from one another. That is, the lash band 80 has a non-uniform physical and/or chemical property along the length L5 thereof. Said physical and/or chemical properties may include, but are not limited to, stiffness, flexibility, elasticity (elastic modulus), hardness, glass transition temperature ($T_g$), moment of inertia, tensile strength, tensile modulus, density, composition, melting point, degree of cross-linking, or combinations thereof.

In some embodiments, the first end portion 81 can include a coating layer while the main portion 87 lacks a coating layer. In some embodiments, the main portion 87 may include a coating layer while the first end portion 81 lacks the coating layer. In some embodiments, the first end portion 81 may include first coating layer and the main portion 87 may include a second coating layer that is of a different composition or thickness than the first coating layer. Examples of coating layers include, but are not limited to, a stiffening agent such as a curable polymer, a lubricant, a tackifier, and/or an abrasive material. The coating layer may provide the first end portion 81 and/or the main portion 87 with distinct physical and/or chemical properties and also change the cross-sectional dimensions thereof.

In some embodiments, the first end portion 81 is more flexible than the main portion 87. In some embodiments, the first end portion 81 is less flexible than the main portion 87. In some embodiments, the first end portion 81 is less dense than the main portion 87. In some embodiments, the first end portion 81 is denser than the main portion 87. In some embodiments, the first end portion 81 is less stiff than the main portion 87. In some embodiments, the first end portion 81 is stiffer than the main portion 87. In some embodiments, the first end portion 81 is formed of a different material than that of the main portion 87.

In an embodiment, as shown in FIG. 8A, the variation of at least one property (e.g., a non-dimensional property) along the length L5 of the lash band 80 accommodates irregularities of the eyeline 18 at the inner corner thereof, such as those described above. In operation, as discussed above with reference to FIG. 1, the first end 82 is configured to be attached to natural lashes 16 proximate an inner corner of the eyeline 18. Accordingly, varied property (e.g., increased flexibility) of the first end 82 as compared to the remainder of the lash band 80 accommodates structural irregularities of the eyeline 18 at the inner corner thereof (e.g., a higher degree of curvature) and thereby reduces the risk of premature disengagement of the lash band 80 (and an extension unit comprising the same) from the eyeline 18 and/or natural lashes 16. Further, the varied property (e.g., increased flexibility) of the first end 82 allows for a more comfortable fit as the eyeline 18 may be more sensitive closer to the inner corner due to, e.g., more delicate skin and/or a sharper degree of curvature.

Figure 8B:
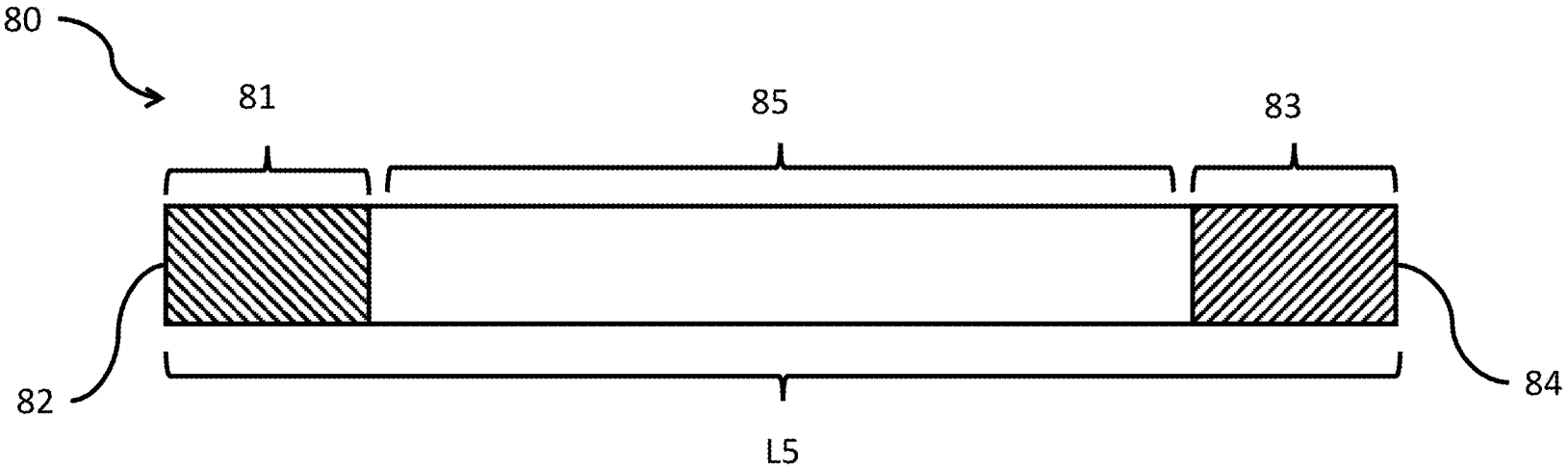
FIG. 8B is a top view of a lash band according to an embodiment of the present disclosure.

Turning to FIG. 8B, an alternative embodiment of the lash band 80 is shown. The lash band 80 includes the first end portion 81 proximate the first end 82, a second end portion 83 proximate the second end 84, and a middle portion 85 between the first end portion 81 and the second end portion 83. In one or more embodiments, at least two of the first end portion 81, the middle portion 85, and the second end portion 83 have different physical and/or chemical properties from one another. That is, the lash band 80 has a non-uniform physical and/or chemical property along the length L5 thereof. Said physical and/or chemical properties may include those discussed above.

In some embodiments, the first end portion 81 and/or the second end portion 83 can include a coating layer while the middle portion 85 lacks a coating layer. In some embodiments, the middle portion 85 may include a coating layer while the first end portion 81 and/or the second end portion 83 lacks the coating layer. In some embodiments, the first end portion 81 and/or the second end portion 83 may include first coating layer and the middle portion 85 may include a second coating layer that is of a different composition or thickness than the first coating layer. In some embodiments, the first end portion 81 may include a first coating layer, the middle portion 85 may include a second coating layer, and the second end portion 83 may include a third coating layer, wherein at least two of the first coating layer, the second coating layer, and the third coating layer are of different compositions or thicknesses. Examples of coating layers include those described above.

In some embodiments, at least one of the first end portion 81 or the second end portion 83 is more flexible than the middle portion 85. In some embodiments, at least one of the first end portion 81 or the second end portion 83 is less flexible than the middle portion 85. In some embodiments, at least one of the first end portion 81 or the second end portion 83 is less dense than the middle portion 85. In some embodiments, at least one of the first end portion 81 or the second end portion 83 is denser than the middle portion 85. In some embodiments, at least one of the first end portion 81 or the second end portion 83 is less stiff than the middle portion 85. In some embodiments, at least one of the first end portion 81 or the second end portion 83 is stiffer than the middle portion 85. In some embodiments, at least one of the first end portion 81 or the second end portion 83 is formed of a different material than that of the middle portion 85.

In an embodiment, as shown in FIG. 8B, operations and advantages of the lash band 80 include those described with reference to FIG. 8A. Further, by providing variable properties at both the first end portion 81 and the second end portion 83, the lash band 80 is able to accommodate irregularities at both ends of the eyeline 18.

Figure 9:
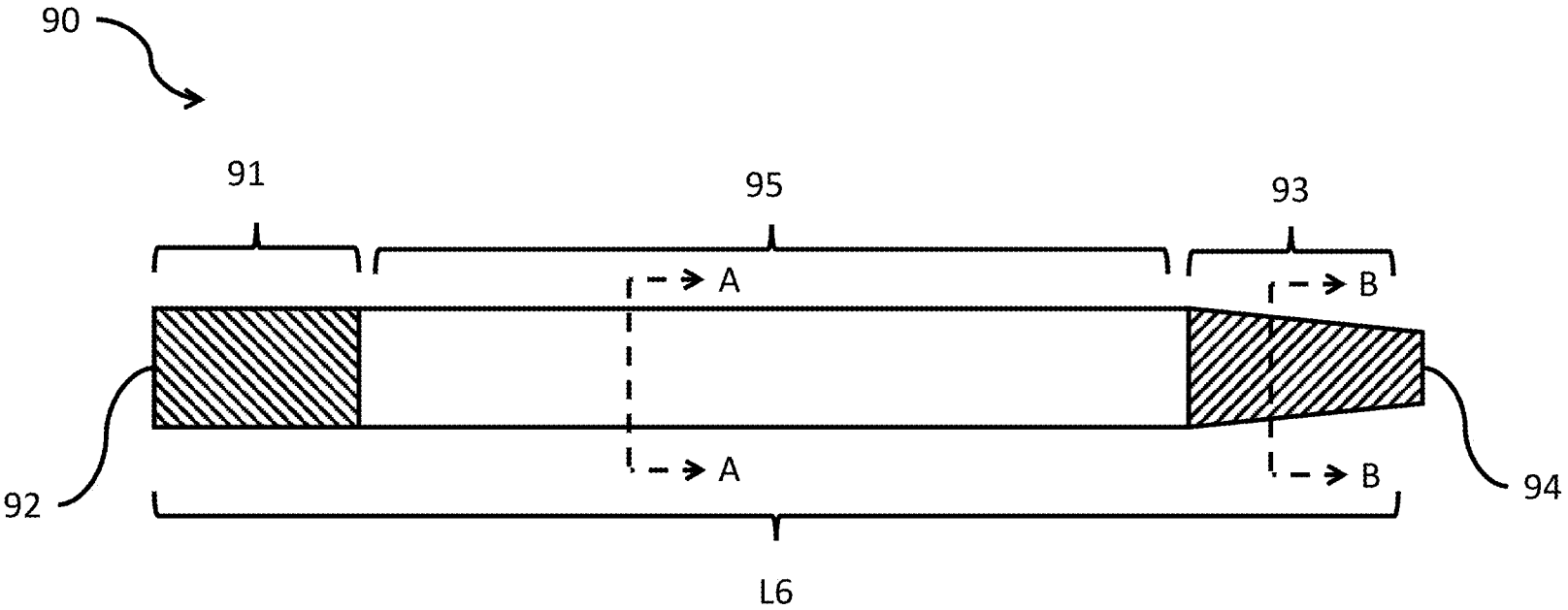
FIG. 9 is a top view of a lash band according to an embodiment of the present disclosure.
Figure 9A:
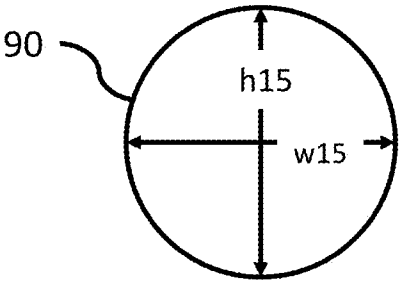
FIG. 9A is a cross-sectional view along line A-A in FIG. 9.
Figure 9B:
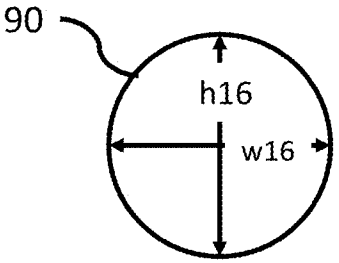
FIG. 9B is a cross-sectional view along line B-B in FIG. 9.

Turning to FIG. 9, another embodiment of a lash band 90 is shown. The lash band 90 has a first end 92, a second end 94, and a length L6 defined between the first end 92 and the second end 94. The lash band 90 includes a first end portion 91 proximate the first end 92, a second end portion 93 proximate the second end 94, and a middle portion 95 between the first end portion 91 and the second end portion 93. In one or more embodiments, at least two of the first end portion 91, the middle portion 95, and the second end portion 93 have different physical and/or chemical properties from one another. That is, the lash band 90 has a non-uniform physical and/or chemical property along the length L6 thereof. FIG. 9A is a cross-sectional view along the line A-A in FIG. 9. In FIG. 9A, it can be seen that the lash band 90 has dimensions h15 and w15 at this position along the length L6 of the lash band 90, wherein h15 and w15 may be the same or different from one another. FIG. 9B is a cross-sectional view along the line B-B in FIG. 9. In FIG. 9B, it can be seen that the lash band 90 has dimensions h16 and w16 at this position along the length L6 of the lash band 90, wherein h16 and w16 may be the same or different from one another. According to some embodiments, h15 and h16 are different from one another and/or at w15 and w16 are different from one another. That is, the lash band 90 has at least one non-uniform dimension along the length L6 thereof.

In an embodiment, as shown in FIGS. 9, 9A, and 9B, operations and advantages of the lash band 90 include those described above with reference to FIGS. 2, 2A, 2B, 8A, and 8B.

Figure 10:
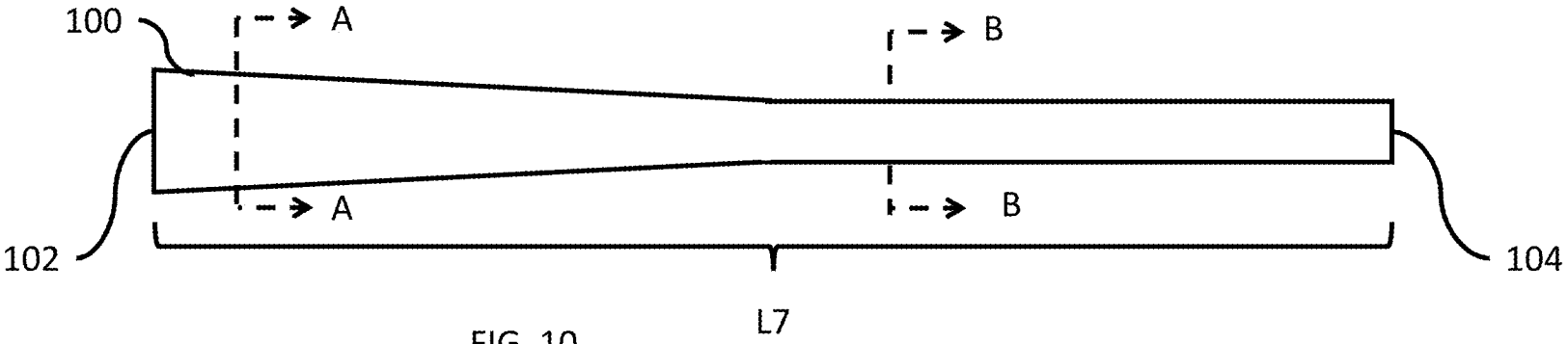
FIG. 10 is a top view of a lash band according to an embodiment of the present disclosure.
Figure 10B:
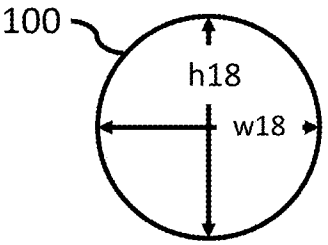
FIG. 10B is a cross-sectional view along line B-B in FIG. 10.
Figure 10A:
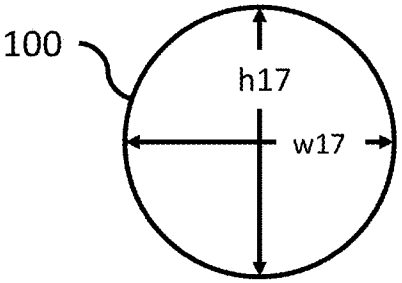
FIG. 10A is a cross-sectional view along line A-A in FIG. 10.

Referring to FIG. 10, another lash band 100 according to an embodiment of the present disclosure is shown. The lash band 100 include a first end 102 and a second end 104 with a length L7 defined therebetween. FIG. 10A is a cross-sectional view along the line A-A in FIG. 10. In FIG. 10A, it can be seen that the lash band 100 has dimensions h17 and w17 at this position along the length L7 of the lash band 100, wherein h17 and w17 may be the same or different from one another. FIG. 10B is a cross-sectional view along the line B-B in FIG. 10. In FIG. 10B, it can be seen that the lash band 100 has dimensions h18 and w18 at this position along the length L7 of the lash band 100, wherein h18 and w18 may be the same or different from one another. According to some embodiments of the present disclosure, h17 and h18 are different from one another and/or w17 and w18 are different from one another. That is, the lash band 100 has at least one non-uniform dimension along the length L7 thereof.

In an embodiment, as shown in FIGS. 10, 10A, and 10B, the lash band 100 provides increased surface area at the first end 102 thereof for improved adhesion near the inner corner of the eyeline 18, thereby reducing the occurrence of premature disengagement of an extension unit comprising the lash band 100.

Figure 11:
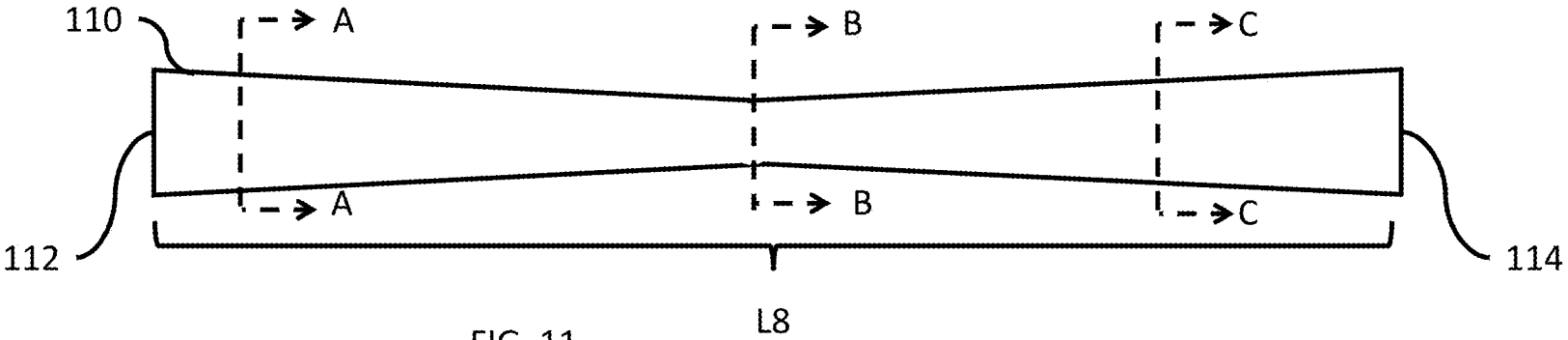
FIG. 11 is a top view of a lash band according to an embodiment of the present disclosure.
Figure 11C:
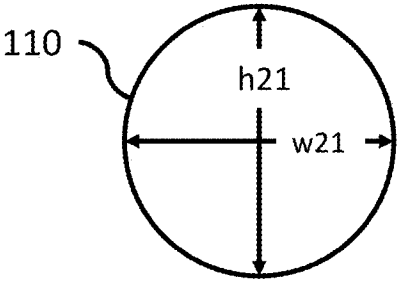
FIG. 11C is a cross-sectional view along line C-C in FIG. 11.
Figure 11B:
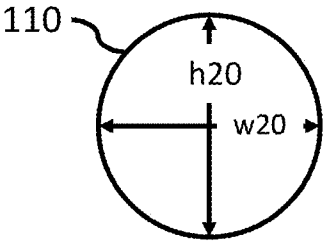
FIG. 11B is a cross-sectional view along line B-B in FIG. 11.
Figure 11A:
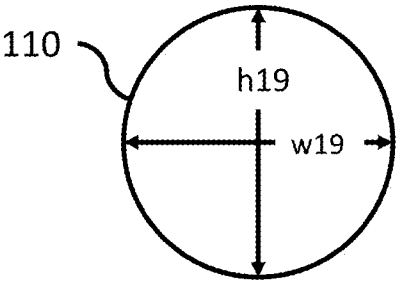
FIG. 11A is a cross-sectional view along line A-A in FIG. 11.

Referring to FIG. 11, another lash band 110 according to an embodiment of the present disclosure is shown. The lash band 110 include a first end 112 and a second end 114 with a length L8 defined therebetween. FIG. 11A is a cross-sectional view along the line A-A in FIG. 11. In FIG. 11A, it can be seen that the lash band 110 has dimensions h19 and w19 at this position along the length L8 of the lash band 110, wherein h19 and w19 may be the same or different from one another. FIG. 11B is a cross-sectional view along the line B-B in FIG. 11. In FIG. 11B, it can be seen that the lash band 110 has dimensions h20 and w20 at this position along the length L8 of the lash band 110, wherein h20 and w20 may be the same or different from one another. FIG. 11C is a cross-sectional view along the line C-C in FIG. 11. In FIG. 11C, it can be seen that the lash band 110 has dimensions h21 and w21 at this position along the length L8 of the lash band 110, wherein h21 and w21 may be the same or different from one another. According to some embodiments of the present disclosure, at least two of h19, h20, and h11 are different from one another and/or at least two of w19, w20, and w21 are different from one another. That is, the lash band 110 has at least one non-uniform dimension along the length L8 thereof.

In an embodiment, as shown in FIGS. 11, 11A, 11B, and 11C, operations and advantages of the lash band 110 include those described with reference to FIGS. 10, 10A, and 10B above. Additionally, the lash band 110 also provides increased surface area at the second end 114 thereof for improved adhesion near the outer corner of the eyeline 18, thereby further reducing the occurrence of premature disengagement of an extension unit comprising the lash band 110.

Figure 12A:
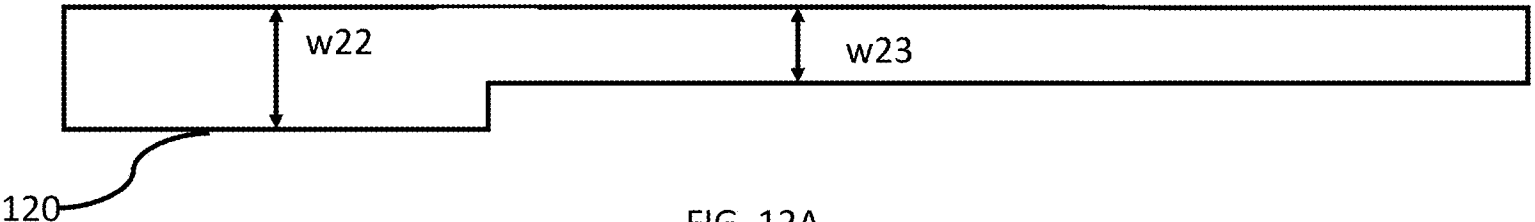
FIG. 12A is a top view of a lash band according to an embodiment of the present disclosure.
Figure 12B:
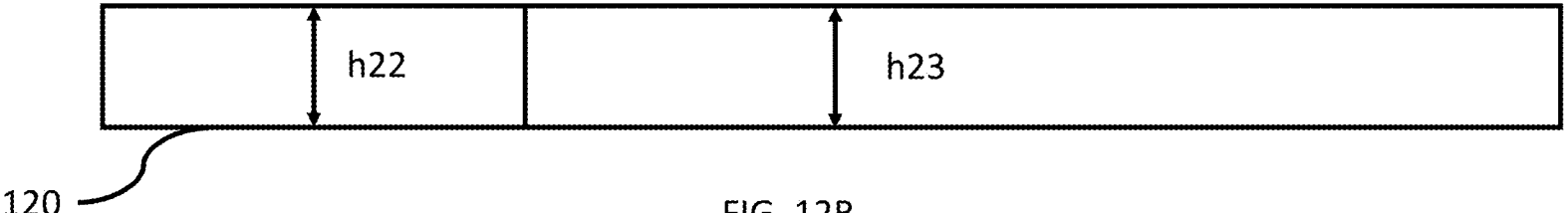
FIG. 12B is a front view of the lash band of FIG. 12A.

Turning to FIG. 12A and FIG. 12B, a lash band 120 according to an embodiment of the present disclosure is shown. The lash band 120 includes a stepped profile, wherein dimension w23 is less than w22. In FIG. 12B, the dimensions h22 and h23 may be the same or different. The dimensions w22 and h22 are taken at the same longitudinal position on the lash band 120 and may be the same or different. Likewise, the dimensions w23 and h23 are taken at the same longitudinal position on the lash band 120 and may be the same or different.

In an embodiment, as shown in FIGS. 12A and 12B, operations and advantages of the lash band 120 include those described with reference to FIGS. 10, 10A, and 10B above.

Figure 13A:
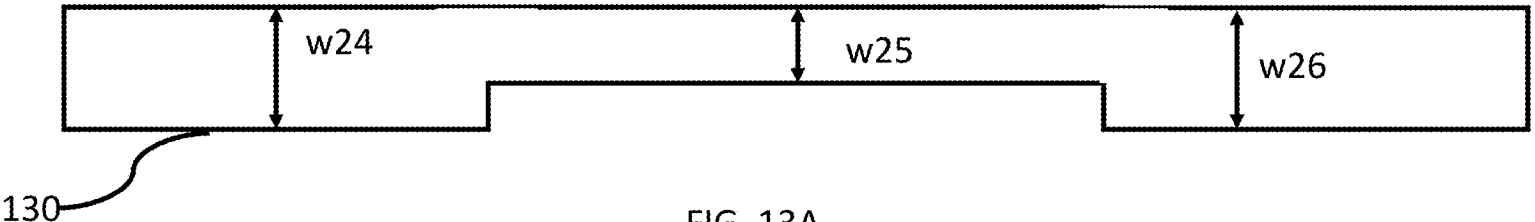
FIG. 13A is a top view of a lash band according to an embodiment of the present disclosure.
Figure 13B:
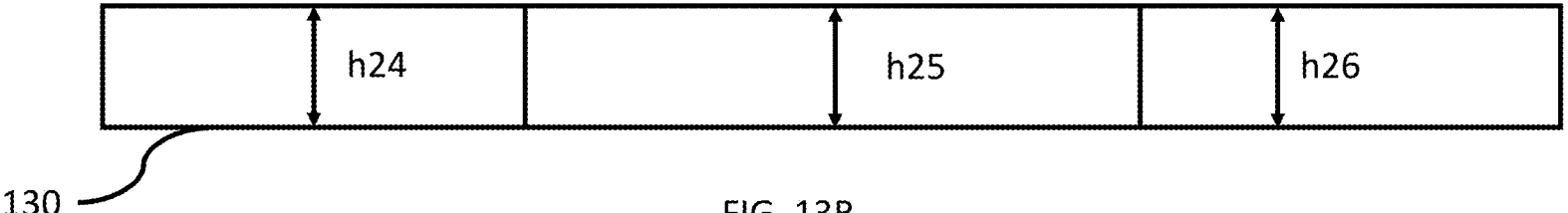
FIG. 13B is a front view of the lash band of FIG. 13A.

Referring to FIG. 13A and FIG. 13B, a lash band 130 according to an embodiment of the present disclosure is shown. The lash band 120 includes a stepped profile, wherein dimensions w24 and w26 are each is greater than w10. In FIG. 13B, the dimensions h24, h25, and h26 may be the same or different. The dimensions w24 and h24 are taken at the same longitudinal position on the lash band 130 and may be the same or different. Likewise, the dimensions w25 and h25 are taken at the same longitudinal position on the lash band 60 and may be the same or different. Lastly, the dimensions w26 and h26 are taken at the same longitudinal position on the lash band 130 and may be the same or different.

In an embodiment, as shown in FIGS. 13A and 13B, operations and advantages of the lash band 120 include those described with reference to FIGS. 10, 10A, 10B, 11, 11A, 11B, and 11C above.

The lash bands described herein may be formed of any suitable materials including, but not limited to, plastics, polymers, elastomers, rubbers, organic or inorganic threads, and combinations thereof. The lash band includes a property that is non-uniform along the length of the lash band. This property may be physical, chemical, or both physical and chemical. Examples of the non-uniform property include a cross-sectional dimension, composition, or one or more physical and/or chemical properties such as stiffness, flexibility, elasticity (elastic modulus), glass transition temperature, moment of inertia, hardness, tensile strength, tensile modulus, density, composition, melting point, degree of cross-linking, or combinations thereof.

Various methods may be employed to form the lash band. In some embodiments, the lash band is formed of two or more segments bonded together, wherein at least two of the segments differ in at least one of the aforementioned properties. In some embodiments, three segments are bonded together wherein at least two of the segments differ in at least one of the aforementioned properties.

In some embodiments, one or both end portions of the lash band may be tapered. In such embodiments, tapering may include chemical tapering and/or mechanical or physical tapering (e.g., attenuating, deforming, or cutting). In some embodiments, a cross-sectional dimension near at least one end of the lash band may be reduced relative to the same cross-sectional dimension at a middle portion of the lash band between the first and second ends. In some of these embodiments, the lash band may be formed by cutting at an angle that is not perpendicular or parallel to a longitudinal axis of the lash band.

In some embodiments, a cross-sectional dimension of the lash band may be varied along the length thereof by applying a coating layer to only a portion thereof or applying a coating layer of uneven thickness to the lash band (e.g., a heavier coating at one end, both ends, or a middle portion of the lash band). In some embodiments, the coating layer may be of a different composition than that forming the remainder of the lash band. In other embodiments, the coating layer may be of the same composition as that forming the remainder of the lash band.

In some embodiments, the lash band may be formed by chemically altering at least a portion thereof. For example, an elastic modulus of the lash band may be increased at a portion thereof by curing said portion using heat, radiation, or a crosslinking reagent to, e.g., increase a degree of cross-linking. In another example, an elastic modulus of a portion of the lash band may be decreased by, e.g., degrading the material (e.g., an elastomer) at said portion using a reagent such as an acid or base and/or breakings cross-linkages in said portion using a cleaving agent or physical deformation. In some embodiments, the lash band may be formed by physically deforming a portion thereof to increase the softness and/or elasticity of said portion.

The lash band and artificial eyelash employing the same disclosed herein are able to provide better adhesion and durability when applied to natural eyelashes or an eyeline. The lash band can be tailored to the nonuniform nature of natural eyelashes/eyes and of many artificial eyelash extension units (e.g., variable lash filament lengths). By changing the properties of the lash band along a length thereof, the artificial eyelash may also be more comfortable to wear for a user.

A lash band for an artificial eyelash extension unit has been described herein. The lash band includes an elongated base having a first end, a second end, and a length defined therebetween, wherein the elongated base comprises a property that is non-uniform along the length of the elongated base. The lash band may include any one or more of the following features:

a. wherein the property is a cross-sectional dimension;
b. wherein the property is stiffness, flexibility, elasticity (elastic modulus), glass transition temperature, moment of inertia, hardness, tensile strength, tensile modulus, density, composition, melting point, degree of cross-linking, or combinations thereof;
c. wherein the property is composition;
d. wherein the lash band is tapered from a middle portion between the first end and the second end to at least one of the first end or the second end;
e. wherein the lash band is tapered from the first end and from the second end toward a middle portion between the first end and the second end;
f. wherein the lash band has a circular cross-section, and a diameter of the cross-section is variable along the length of the elongated base;
g. wherein the lash band has a rectangular cross-section;
h. wherein the lash band has a first elastic modulus at a middle portion between the first end and the second end and a second elastic modulus that is lower than the first elastic modulus at the first end;
i. wherein the lash band has a first elastic modulus at a middle portion between the first end and the second end and a second elastic modulus that is higher than the first elastic modulus at the first end;

j. wherein the property is a physical property;

k. wherein the property is a chemical property;

l. wherein a first portion adjacent the first end is coated with a coating and a second portion is not coated with the coating; and/or m. wherein a first portion adjacent the first end is coated with a first coating and a second portion is coated with a second coating of a different composition than the first coating.

An artificial eyelash extension unit has been described herein. The artificial eyelash extension unit includes the lash band described above, optionally including any one or more of features a-m. The artificial eyelash extension unit further includes a plurality of artificial lashes attached to and extending from the lash band.

The artificial eyelash extension unit may include a feature wherein the plurality of artificial eyelashes comprises at least a first lash having a first length positioned at a first position on the elongated base proximate the first end and a second lash having a second length positioned at a second position on the elongated base between the first lash and the second end, wherein the first length is shorter than the second length; and wherein the elongated base has a smaller cross-sectional area at the first position than at the second position.

A method of making a lash band for an artificial eyelash extension unit has been described herein. The lash band formed by this method may be that described above, optionally including any one or more of features a-m. The method may include any one or more of the following features:

mechanically and/or chemically altering the physical property of at least a portion of the lash band;

mechanically and/or chemically tapering a portion of the lash band proximate the first end and/or the second end;

increasing an elastic modulus of a middle portion of the lash band between the first end and the second end;

decreasing an elastic modulus of a portion of the lash band proximate the first end and/or the second end;

cutting the elongated base at an angle that is neither perpendicular to a longitudinal axis of the elongated base nor parallel to the longitudinal axis;

applying a coating layer to a first portion of the lash band and omitting the coating layer for a second portion of the lash band; and/or joining together at least two materials having different compositions and/or physical properties to form the elongated base.

It is understood that variations may be made in the foregoing without departing from the scope of the disclosure.

In one or more embodiments, the elements and teachings of the various disclosed embodiments may be combined in whole or in part in some or all of the disclosed embodiments. In addition, one or more of the elements and teachings of the various disclosed embodiments may be omitted, at least in part, or combined, at least in part, with one or more of the other elements and teachings of the various disclosed embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In one or more embodiments, while different steps, processes, and procedures are described as appearing as distinct acts, one or more of the steps, one or more of the processes, or one or more of the procedures may also be performed in different orders, simultaneously or sequentially. In one or more embodiments, the steps, processes, or procedures may be merged into one or more steps, processes, or procedures. In one or more embodiments, one or more of the operational steps in each embodiment may be omitted. Moreover, in some instances, some features of the present disclosure may be employed without a corresponding use of the other features.

Although several embodiments have been disclosed in detail above, the embodiments disclosed are not limiting, and those skilled in the art will readily appreciate that many other modifications, changes, and substitutions are possible in the disclosed embodiments without materially departing from the novel teachings and advantages of the present disclosure. Accordingly, all such modifications, changes, and substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112 (f) for any limitations of any of the claims herein, except for those in which the claim expressly uses the word "means" together with an associated function.

What is claimed is:

1. A lash band for an artificial eyelash extension unit comprising:

an elongated base having an inner end, an outer end, and a length defined therebetween, the length extending along a longitudinal axis of the elongated base;

wherein the inner end of the elongated base is configured to be positioned proximate an inner corner of an eyeline;

wherein, at the inner end, the elongated base has a circular, rectangular, or elliptical cross-section, the circular, rectangular, or elliptical cross-section being taken along a first plane perpendicular to the longitudinal axis of the elongated base, the circular, rectangular, or elliptical cross-section at the inner end defining:

a first dimension, a second dimension perpendicular to the first dimension, and a first cross-sectional area based on the first and second dimensions;

wherein, at the outer end, the elongated base has a circular, rectangular, or elliptical cross-section being taken along a second plane perpendicular to the longitudinal axis of the elongated base, the circular, rectangular, or elliptical cross-section at the outer end defining:

a third dimension, a fourth dimension perpendicular to the third dimension, and a second cross-sectional area based on the third and fourth dimensions;

wherein the second plane is spaced in a parallel relation from the first plane;

wherein, at a third position between the inner end and the outer end, the elongated base has a circular, rectangular, or elliptical cross-section being taken along a third plane perpendicular to the longitudinal axis of the elongated base, the circular, rectangular, or elliptical cross-section at the third position defining:

a fifth dimension, a sixth dimension perpendicular to the fifth dimension, and a third cross-sectional area based on the fifth and sixth dimensions;

wherein the third plane is spaced in a parallel relation from the first plane and the second plane; and wherein the third cross-sectional area is less than the first cross-sectional area and the third cross-sectional area is less than the second cross-sectional area.

2. The lash band of claim 1, wherein the elongated base comprises a non-uniform composition along the length thereof.

3. The lash bad of claim 2, wherein the non-uniform composition comprises a coating layer on a first portion of the elongated base, the coating layer being absent from a second portion of the elongated base.

4. The lash band of claim 1, wherein the cross-section at the inner end, the outer end, and/or the third position is circular.

5. The lash band of claim 1, wherein the cross-section at the inner end, the outer end, and/or the third position is rectangular.

6. The lash band of claim 1, wherein the cross-section at the inner end, the outer end, and/or the third position is elliptical.

7. The lash band of claim 1, wherein the length of the elongated base is approximately equal to a length of the eyeline.

8. The lash band of claim 1, wherein the elongated base is tapered from the inner end and/or the outer end to the third position.

9. The lash band of claim 1, wherein the elongated base has a stepped cross-sectional profile being taken along a fourth plane parallel to the longitudinal axis of the elongated base.

10. An artificial eyelash extension unit comprising:

the lash band of claim 1; and a plurality of artificial lashes attached to and extending from the lash band.

* * * * *